US008749147B2

(12) United States Patent
Lee et al.

(10) Patent No.: US 8,749,147 B2
(45) Date of Patent: Jun. 10, 2014

(54) LED CIRCUIT

(75) Inventors: Yeun Joong Lee, Seoul (KR); Deuk Hee Park, Gyunggi-do (KR); Sang Hyun Cha, Seoul (KR); Jae Shin Lee, Gyunggi-do (KR); Change Seok Lee, Seoul (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 463 days.

(21) Appl. No.: 13/224,083

(22) Filed: Sep. 1, 2011

(65) Prior Publication Data

US 2012/0299490 A1 Nov. 29, 2012

(30) Foreign Application Priority Data

May 24, 2011 (KR) ..... 10-2011-0049093

(51) Int. Cl.
*H05B 37/00* (2006.01)
*H05B 37/02* (2006.01)

(52) U.S. Cl.
USPC ..... 315/185 R; 315/192; 315/307

(58) Field of Classification Search
CPC ..... H05B 37/00; H05B 37/02; H05B 33/00; H05B 33/08; H05B 33/0803; H05B 33/0806; H05B 33/0896; H05B 33/0821; H05B 33/0824; H05B 33/083; H05B 33/0815; H05B 33/0827; Y02B 20/345; Y02B 20/347; Y02B 20/30; Y02B 20/342; Y02B 20/346; Y02B 20/341; Y02B 20/35
USPC ..... 315/307, 308, 291, 185 R, 193, 186, 315/224, 192
See application file for complete search history.

(56) References Cited

U.S. PATENT DOCUMENTS

| | | | | |
|---|---|---|---|---|
| 7,902,762 | B2 * | 3/2011 | Chen | 315/209 R |
| 2007/0001625 | A1 * | 1/2007 | Kim | 315/312 |
| 2010/0001657 | A1 * | 1/2010 | Chen | 315/291 |
| 2012/0217887 | A1 * | 8/2012 | Kang et al. | 315/193 |

FOREIGN PATENT DOCUMENTS

| | | | |
|---|---|---|---|
| JP | 2009-283775 | A | 3/2009 |
| KR | 10-2010-0006345 | A | 1/2010 |

* cited by examiner

*Primary Examiner* — David H Vu
(74) *Attorney, Agent, or Firm* — McDermott Will & Emery LLP

(57) ABSTRACT

There is provided an LED circuit. The LED circuit may include 2N+2 light emitting units connected between a 2K−1-th node and a 2K-th node among 4N+4 (N is a natural number) nodes including a first node supplied with input voltage (K is all natural numbers equal to or smaller than 2N+2); 2N+2 switches connected between a 2K-th node and a ground (K is all natural numbers equal to or smaller than 2N+2); 2N+1 switches connected between a 2L−1-th node and a 2L+1-th node and 2N+1 switches connected between a 2L-th node and a 2L+1-th node (L is all natural numbers equal to or smaller than 2N+1); and N switches connected between the first node and a 4M+1-th node (M is all natural numbers equal to or smaller than N).

9 Claims, 5 Drawing Sheets

LED CIRCUIT

CROSS-REFERENCE TO RELATED APPLICATIONS

This application claims the priority of Korean Patent Application No. 10-2011-0049093 filed on May 24, 2011, in the Korean Intellectual Property Office, the disclosure of which is incorporated herein by reference.

BACKGROUND OF THE INVENTION

1. Field of the Invention

The present invention relates to an LED circuit having an LED array structure capable of being changed according to a level of input voltage.

2. Description of the Related Art

Alight emitting diode (LED) is a semiconductor device that is configured as a p-n junction structure and emits light by the recombination of electrons and holes. The light emitting diode may be manufactured to have a small size while having excellent monochromatic peak wavelength and light efficiency and may be manufactured in an environmentally-friendly way, while having reduced power consumption, or the like. For this reason, the light emitting diode has rapidly replaced existing lighting devices.

In general, the light emitting diode is driven by a DC voltage of several volts. Therefore, a circuit for driving the existing light emitting diode mainly uses a scheme in which commercial AC voltage is rectified and then constant current is supplied to a light emitting device using a converter such as a flyback converter.

The driving circuit essentially includes a smoothing capacitor. The smoothing capacitor has a short lifespan, such that the lifespan of the lighting device using the light emitting diode may be shortened.

In addition, existing LED circuit drives the light emitting diode by using only a rectified waveform so as not to use the smoothing capacitor, and cannot drive all light emitting diodes at a predetermined voltage or less and is thus inefficient.

SUMMARY OF THE INVENTION

An aspect of the present invention provides an LED circuit capable of driving light emitting diodes by rectified commercial AC voltage so as not to use a smoothing capacitor and driving all light emitting diodes at all times while changing a light emitting diode array structure according to a voltage level.

According to an aspect of the present invention, there is provided an LED circuit, including: 2N+2 light emitting units connected between a 2K−1-th node and a 2K-th node among 4N+4 (N is a natural number) nodes including a first node supplied with input voltage (K is all natural numbers equal to or smaller than 2N+2); 2N+2 switches connected between a 2K-th node and a ground (K is all natural numbers equal to or smaller than 2N+2); 2N+1 switches connected between a 2L−1-th node and a 2L+1-th node and 2N+1 switches connected between a 2L-th node and a 2L+1-th node (L is all natural numbers equal to or smaller than 2N+1); and N switches connected between the first node and a 4M+1-th node (M is all natural numbers equal to or smaller than N).

The LED circuit may further include a control unit controlling the switches according to a voltage level of the input voltage.

The LED circuit may further include a control unit that controls the switches to connect the light emitting units to each other in parallel when the input voltage is larger than a predetermined first voltage and smaller than a predetermined second voltage, controls the switches to connect the light emitting units in series/parallel when the input voltage is larger than the second voltage and smaller than a predetermined third voltage, and controls the switches to connect the light emitting units to each other in series when the input voltage is larger than the third voltage.

The LED circuit may further include a control unit that turns-on the 2N+1 switches connected between the 2L−1-th node and the 2L+1-th node (L is all natural numbers equal to or smaller than 2N+1) and the 2N+2 switches connected between the 2K-th node and the ground (K is all natural numbers equal to or smaller than 2N+2) and turns-off remaining switches when N=1 and the input voltage is larger than a predetermined first voltage and is smaller than a predetermined second voltage, turns-on switches in which L is an odd number among the 2N+1 switches connected between the 2L-th node and the 2L+1-th node (L is all natural numbers equal to or smaller than 2N+1) and switches in which K is an even number among the 2N+2 switches connected between the 2K-th node and the ground (K is all natural numbers equal to or smaller than 2N+2), turns-on the N switches connected between the first node and the 4M+1-th node (M is all natural numbers equal to or smaller than N), and turns-off remaining switches when the input voltage is larger than the second voltage and is smaller than a predetermined third voltage, and turns-on the 2N+1 switches connected between the 2L-th node and the 2L+1-th node (L is all natural numbers equal to or smaller than 2N+1) and turns-off remaining switches when the input voltage is larger than the third voltage.

The light emitting unit may include a plurality of light emitting diodes.

The LED circuit may further include an independent current source between the 2N+2 switches connected between the 2K-th node and the ground and the ground.

The 2N+1 switches connected between the 2L-th node and the 2L+1-th node may be a light emitting diode.

The LED circuit may further include a rectifying unit rectifying AC voltage and supplying the rectified AC voltage to the first node.

The rectifying unit may include a bridge diode.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
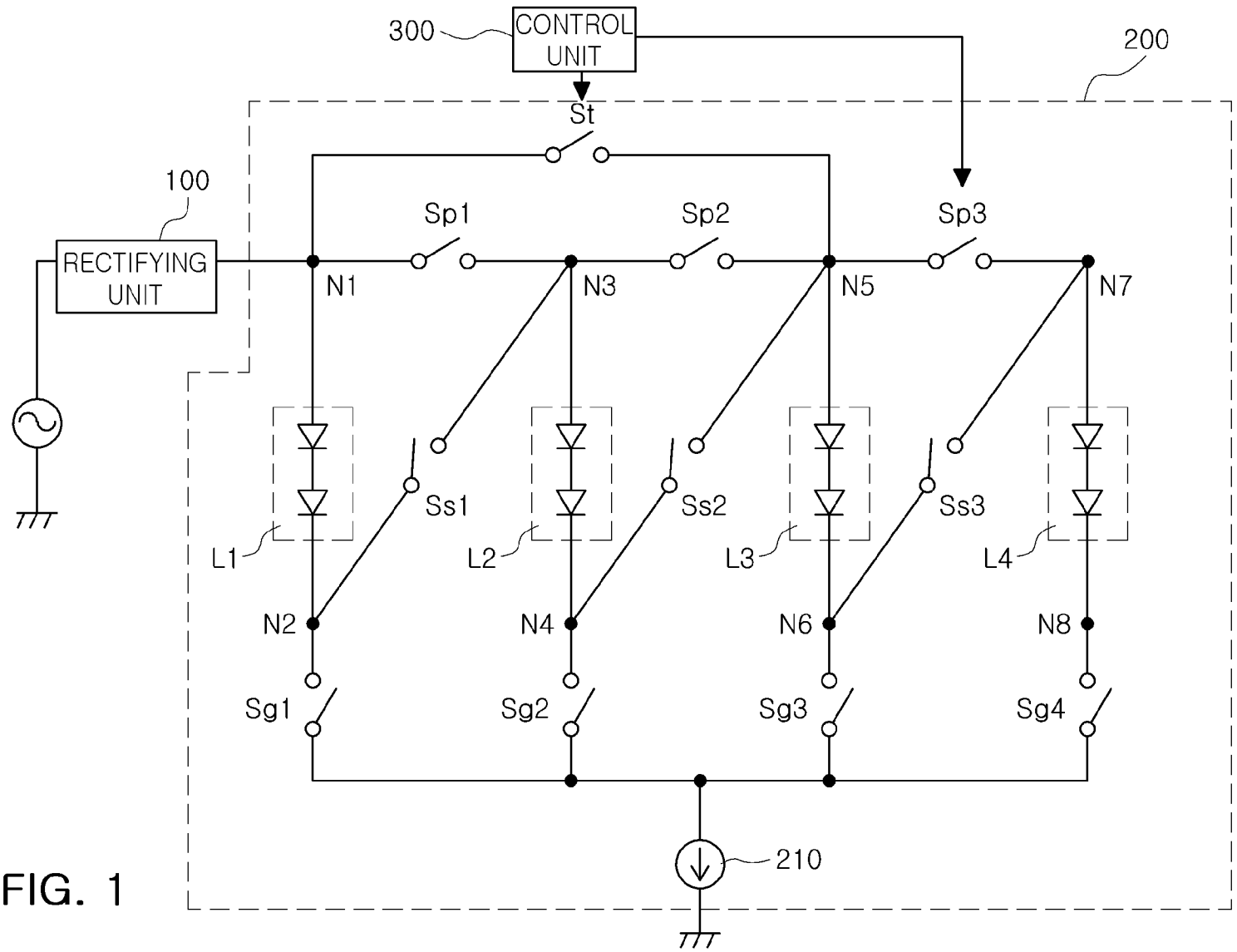
FIG. 1 is a block diagram of an LED circuit according to an embodiment of the present invention.

Hereinafter, exemplary embodiments of the present invention will be described with reference to the accompanying drawings.

The present invention should not be limited to the embodiments set forth herein and the embodiments may be used to assist in understanding the technical idea of the present invention. Like reference numerals designate like components having substantially the same constitution and function in the drawings of the present invention.

FIG. 1 shows a block diagram of an LED circuit according to an embodiment of the present invention.

Referring to FIG. 1, an LED circuit according to the embodiment of the present invention may include a rectifying unit 100, a control unit 300, and an LED array 200 including a plurality of light emitting units and switches.

The rectifying unit 100 may rectify commercial AC voltage. In this case, the rectifying unit 100 may be configured of a bridge diode.

The LED array 200 may include: 2N+2 light emitting units connected between a 2K−1-th node and a 2K-th node (K is all natural numbers equal to or smaller than 2N+2) among 4N+4 nodes (N is a natural number) including a first node that controls the switches to connect the light emitting units to each other in parallel when voltage rectified in the rectifying unit 100, that is, the input voltage thereof, is smaller than a predetermined first voltage V1, controls the switches to connect the light emitting units to each other in series and in parallel when the input voltage is larger than the first voltage V1 and smaller than a second voltage V2, and controls the switches to connect the light emitting units to each other in series when the input voltage is larger than the second voltage V2; 2N+2 switches connected between a 2K-th node and a ground (K is all natural numbers equal to or smaller than 2N+2); 2N+1 switches connected between a 2L−1-th node and a 2L+1-th node, 2N+1 switches connected between a 2L-th node and a 2L+1-th node (L is all natural numbers equal to or smaller than 2N+1); and N switches connected between the first node and a 4M+1-th node (M is a natural number equal to or smaller than N).

Herein, when N=1, the LED array 200 shown in FIG. 1 may be provided. Hereinafter, the case of N=1 will be described.

Being described in more detail, the LED array 200 of FIG. 1 may include a total of 8 nodes N1 to N8 since N=1.

The light emitting units may be connected between the 2K−1-th node and the 2K-th node (K is a natural number equal to or smaller than 2N+2).

Since N=1, the LED array 200 may include a light emitting unit L1 connected between a first node N1 and a second node N2, a light emitting unit L2 connected between a third node N3 and a fourth node N4, a light emitting unit L3 connected between a fifth node N5 and a sixth node N6, and a light emitting unit L4 connected between a seventh node N7 and an eighth node N8.

In this configuration, each of the light emitting units L1 to L4 may include at least one light emitting diode.

In addition, the LED array 200 may include the 2N+2 switches connected between the 2K-th node and the ground (K is all natural numbers equal to or smaller than 2N+2).

That is, the LED array 200 may include a switch Sg1 connected between the second node N2 and the ground, a switch Sg2 connected between the fourth node N4 and the ground, a switch Sg3 connected between the sixth node N6 and the ground, and a switch Sg4 connected between the eighth node N8 and the ground.

In addition, the LED array 200 may include the 2N+1 switches connected between the 2L−1-th node and the 2L+1-th node (L is all natural numbers equal to or smaller than 2N+1).

That is, the LED array 200 may include a switch Sp1 connected between the first node N1 and the third node N3, a switch Sp2 connected between the third node N3 and the fifth node N5, and a switch Sp3 connected between the fifth node N5 and the seventh node N7.

In addition, the LED array 200 may include the 2N+1 switches connected between the 2L-th node and the 2L+1-th node (L is all natural numbers equal to or smaller than 2N+1).

That is, the LED array 200 may include a switch Ss1 connected between the second node N2 and the third node N3, a switch Ss2 connected between the fourth node N4 and the fifth node N5, and a switch Ss3 connected between the sixth node N6 and the seventh node N7.

In addition, the LED array 200 may include the N switches connected between the first node and the 4M+1-th node (M is all natural numbers equal to or smaller than N).

Being described in more detail, since N=1, the LED array 200 may include a switch St connected between the first node N1 and the fifth node N5.

Further, the LED array 200 may further include an independent current source 210 between the 2N+2 switches connected between 2K-th node and the ground and the ground. That is, it can be appreciated from FIG. 1 that the independent current source 210 is connected between the switches Sg1 to Sg4 and the ground. In this configuration, the independent current source 210 may serve to control current flowing in the LED array 200.

Referring next to FIG. 1, the control unit 300 may control the plurality of light emitting units L1 to L4 and the plurality of switches Sg1 to Sg4, Sp1 to Sp3, Ss1 to Ss3, and St according to the voltage level of the rectifying unit 100. Herein, FIG. 1 shows the case in which the control unit 300 transmits control signals to only the switches Sp3 and St, which is only by way of example so as to help in an understanding of the drawing. That is, the control unit 300 may control all the switches Sg1 to Sg4, Sp1 to Sp3, Ss1 to Ss3, and St of the LED array 200.

The control unit 300 may control the switches to connect the light emitting units to each other in parallel when the input voltage from the rectifying unit 100 is smaller than the predetermined first voltage V1, controls the switches to the light emitting units to each other in series/parallel when the input voltage is larger than the first voltage V1 and smaller than the second voltage V2, and controls the switches to connect the light emitting units in series when the input voltage is larger than the second voltage V2.

Hereinafter, the embodiment of the present invention will be described with reference to FIGS. 1 through 5. That is, the structure of the LED array 200 of FIG. 1 may be changed to a structure shown in FIGS. 3 through 5 through the plurality of switches Sg1 to Sg4, Sp1 to Sp3, Ss1 to Ss3, and St that are controlled by the control unit, which will be described in more detail.

Figure 2:
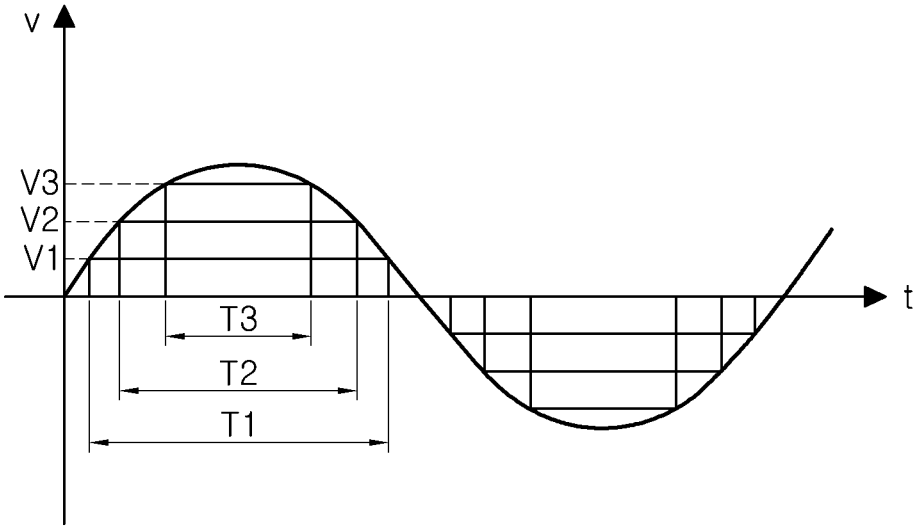
FIG. 2 is a graph for explaining an operation of an input AC power supply and switches of the LED circuit of FIG. 1.

FIG. 2 shows a commercial AC voltage waveform. Respective periods T1 to T3 for a positive half period and the structure of the LED array 200 shown in FIGS. 1 through 4 will be described.

Figure 3:
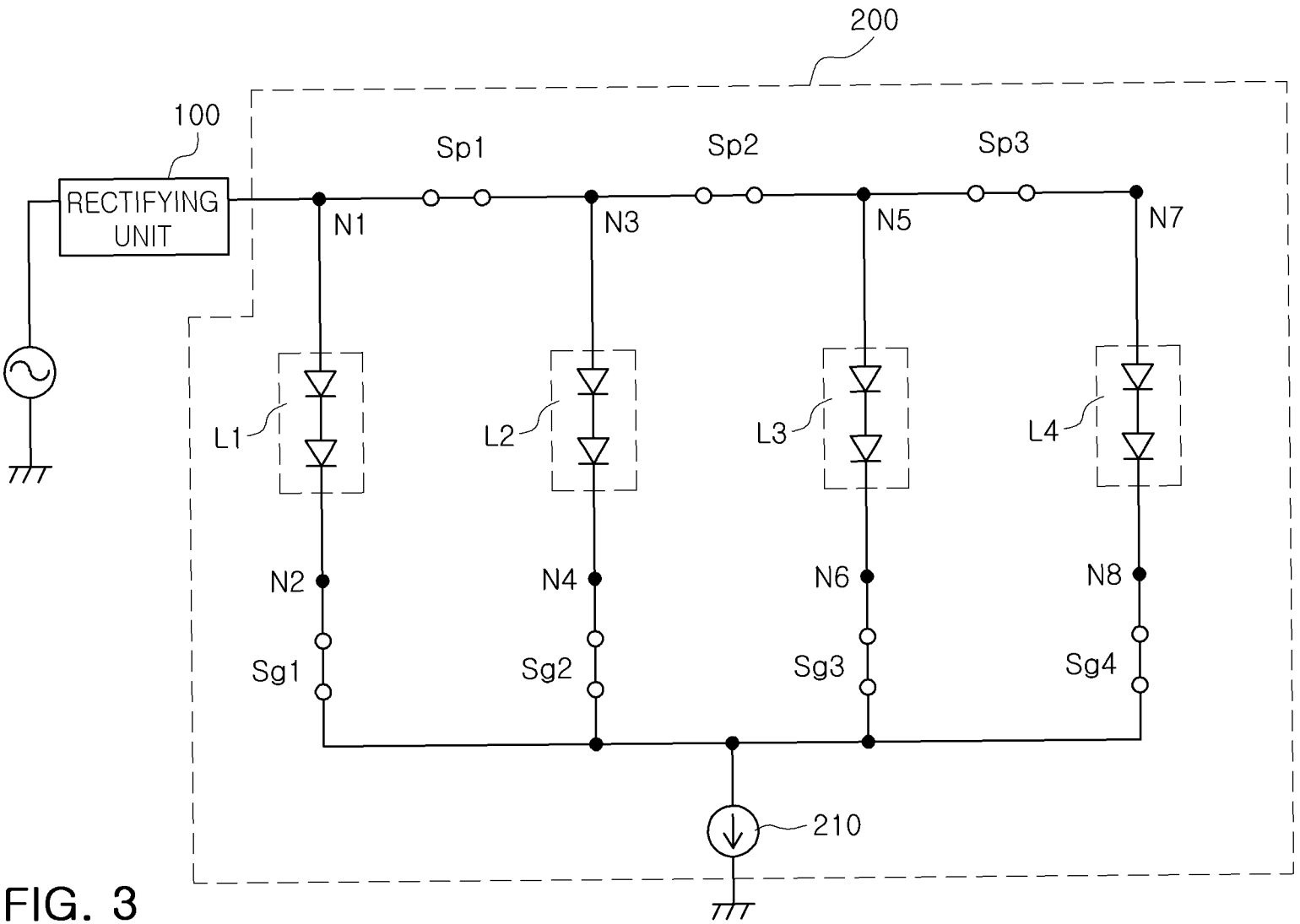
FIGS. 3 through 5 are circuit diagrams showing an array structure of the LED circuit changed according to the embodiment of the present invention.

The LED array 200 shown in FIG. 1 may be a structure in which the light emitting units L1 to L4 are connected to each other in parallel as shown in FIG. 3 in the case of a period (a period being provided by subtracting period T2 from period T1) in which the voltage of FIG. 2 is larger than the first voltage V1 and smaller than the second voltage V2.

In order to change the structure of the LED array 200, the control unit 300 may turn-on the switches Sp1 to Sp3 and Sg1 to Sg4 and turn-off all remaining switches. In this case, the first voltage V1 may be set in advance to a minimum voltage or more so as to drive one of the light emitting units L1 to L4 shown in FIG. 1.

Figure 4:
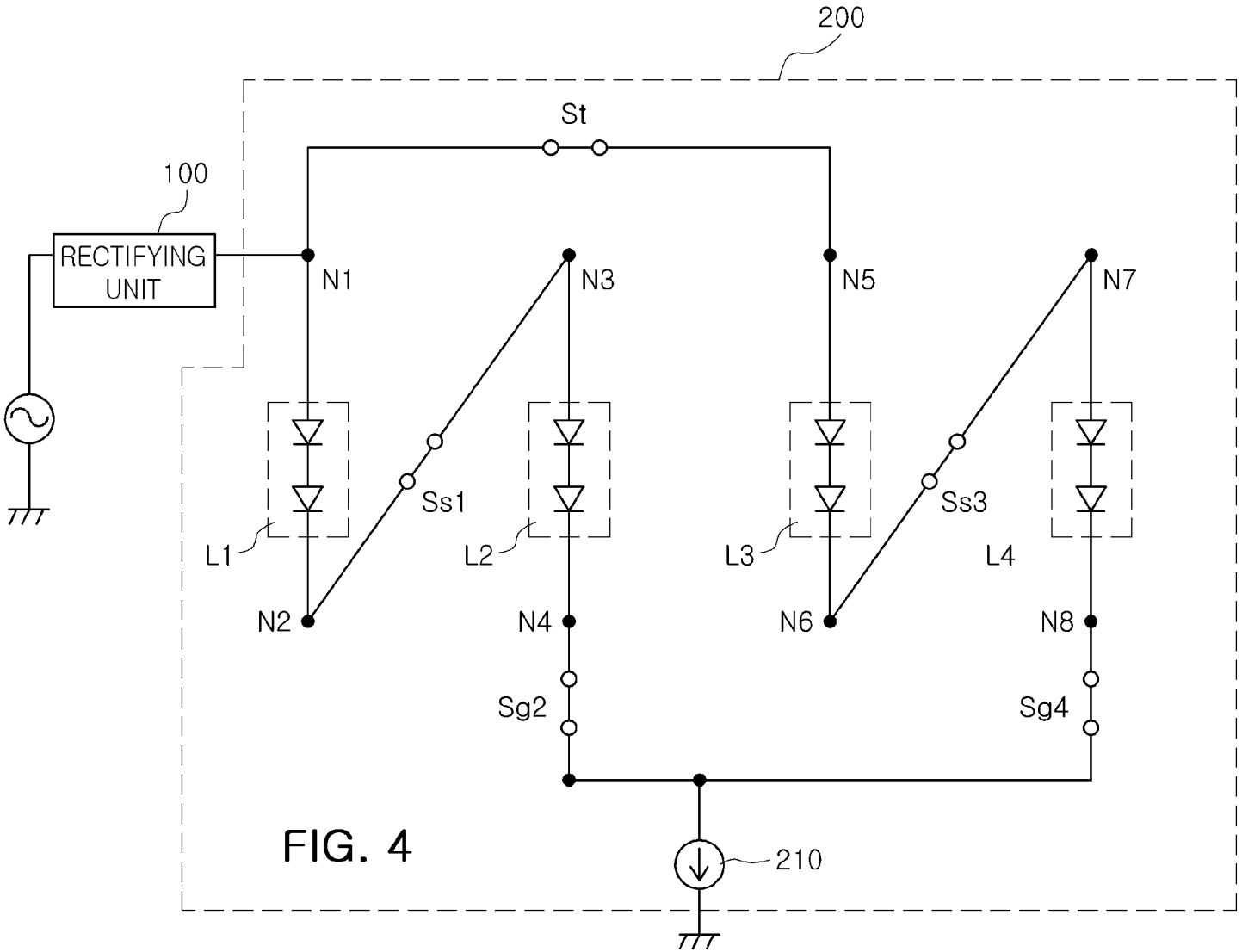

Further, the LED array 200 shown in FIG. 1 may be a structure in which the light emitting units L1 to L4 are connected to each other in series/parallel as shown in FIG. 4 in the case of a period (a period being provided by subtracting period T3 from period T2) in which the voltage of FIG. 2 is larger than the second voltage V2 and smaller than the third voltage V3.

That is, the light emitting unit L1 and the light emitting unit L2 are connected to each other in series and the light emitting unit L3 and the light emitting unit L4 are also connected to each other in series, and the light emitting units connected to each other in series may be a structure in which they are connected to each other in parallel.

As described above, in order to change the structure of the LED array 200, the control unit 300 may turn-on the switches Ss1, Ss3, Sg2, Sg4, and St and turn-off all the rest switches. In this case, the second voltage V2 may be set in advance to be a minimum voltage or more so as to drive two of the light emitting units L1 to L4 shown in FIG. 1.

Figure 5:
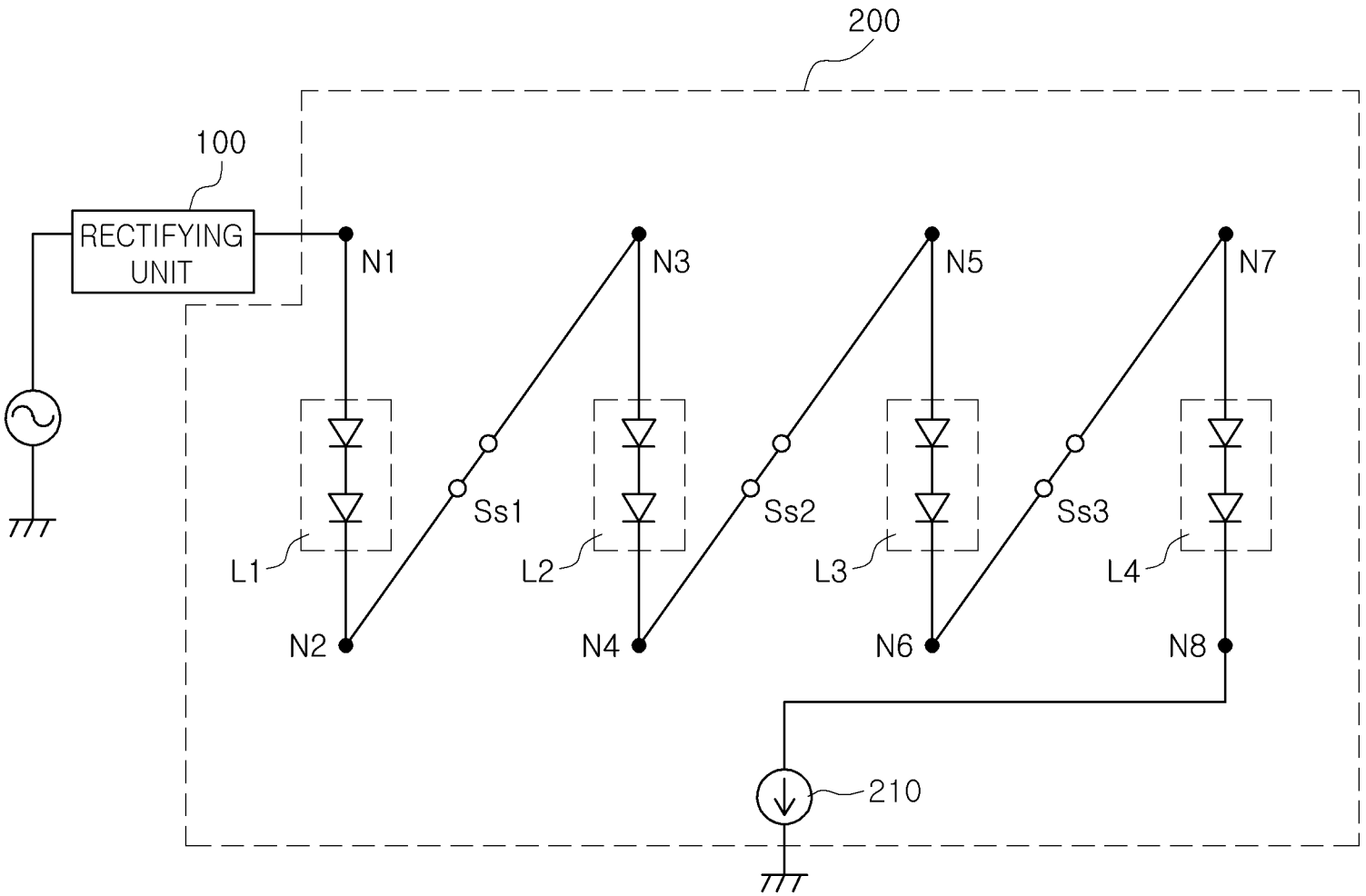

In addition, in a period T3 in which the voltage of FIG. 2 is larger than the third voltage V3, the LED array 200 shown in FIG. 1 may be a structure in which the light emitting units L1 to L4 are connected to each other in series as shown in FIG. 5.

As described above, in order to change the structure of the LED array 200, the control unit 300 may turn-on the switches Ss1-Ss3 and turn-off all remaining switches. In this case, the third voltage V3 may be set in advance to be a minimum voltage or more so as to drive all of the light emitting units L1 to L4 shown in FIG. 1.

Therefore, according to the embodiments of the present invention, the structure of the LED array 200 may be changed according to the change in the voltage level in the waveform in which the commercial AC voltage is rectified. That is, light from all the light emitting diodes included in the LED array 200 may be emitted in most periods T3 of the voltage waveform while driving the light emitting diode by the rectified commercial AC voltage.

Further, according to the embodiment of the present invention, the lifespan of the LED circuit may be prolonged and costs may be efficiently saved since the LED circuit does not use the smoothing capacitor.

As set forth above, according to the embodiment of the present invention, the light emitting diode may be efficiently driven by only the rectified commercial AC voltage. Further, according to the embodiment of the present invention, the lifespan of the LED circuit may be prolonged and costs may be efficiently saved since the LED circuit does not use the smoothing capacitor.

While the present invention has been shown and described in connection with the exemplary embodiments, it will be apparent to those skilled in the art that modifications and variations can be made without departing from the spirit and scope of the invention as defined by the appended claims.

What is claimed is:

1. An LED circuit, comprising:

2N+2 light emitting units connected between a 2K−1-th node and a 2K-th node among 4N+4 (N is a natural number) nodes including a first node supplied with input voltage (K is all natural numbers equal to or smaller than 2N+2);

2N+2 switches connected between a 2K-th node and a ground (K is all natural numbers equal to or smaller than 2N+2);

2N+1 switches connected between a 2L−1-th node and a 2L+1-th node and 2N+1 switches connected between a 2L-th node and a 2L+1-th node (L is all natural numbers equal to or smaller than 2N+1); and N switches connected between the first node and a 4M+1-th node (M is all natural numbers equal to or smaller than N).

2. The LED circuit of claim 1, further comprising a control unit controlling the switches according to a voltage level of the input voltage.

3. The LED circuit of claim 1, further comprising a control unit that controls the switches to connect the light emitting units to each other in parallel when the input voltage is larger than a predetermined first voltage and smaller than a predetermined second voltage, controls the switches to connect the light emitting units in series/parallel when the input voltage is larger than the second voltage and smaller than a predetermined third voltage, and controls the switches to connect the light emitting units to each other in series when the input voltage is larger than the third voltage.

4. The LED circuit of claim 1, further comprising a control unit that turns-on the 2N+1 switches connected between the 2L−1-th node and the 2L+1-th node (L is all natural numbers equal to or smaller than 2N+1) and the 2N+2 switches connected between the 2K-th node and the ground (K is all natural numbers equal to or smaller than 2N+2) and turns-off remaining switches when N=1 and the input voltage is larger than a predetermined first voltage and is smaller than a predetermined second voltage, turns-on switches in which L is an odd number among the 2N+1 switches connected between the 2L-th node and the 2L+1-th node (L is all natural numbers equal to or smaller than 2N+1) and turns-on switches in which K is an even number among the 2N+2 switches connected between the 2K-th node and the ground (K is all natural numbers equal to or smaller than 2N+2), turns-on the N switches connected between the first node and the 4M+1-th node (M is all natural numbers equal to or smaller than N), and turns-off remaining switches when the input voltage is larger than the second voltage and is smaller than a predetermined third voltage, and turns-on the 2N+1 switches connected between the 2L-th node and the 2L+1-th node (L is all natural numbers equal to or smaller than 2N+1) and turns-off remaining switches when the input voltage is larger than the third voltage.

5. The LED circuit of claim 1, wherein the light emitting unit includes a plurality of light emitting diodes.

6. The LED circuit of claim 1, further comprising an independent current source between the 2N+2 switches connected between the 2K-th node and the ground and the ground.

7. The LED circuit of claim 1, wherein the 2N+1 switches connected between the 2L-th node and the 2L+1-th node are a light emitting diode.

8. The LED circuit of claim 1, further comprising a rectifying unit rectifying AC voltage and supplying the rectified AC voltage to the first node.

9. The LED circuit of claim 7, wherein the rectifying unit includes a bridge diode.

* * * * *